US006780824B2

(12) United States Patent
Oelscher et al.

(10) Patent No.: US 6,780,824 B2
(45) Date of Patent: Aug. 24, 2004

(54) EMULSIFIER SYSTEM, ANTI-CORROSIVE AND LOW-TEMPERATURE LUBRICANT EMULSION

(75) Inventors: Hans-Peter Oelscher, Haan (DE); Juergen Geke, Duesseldorf (DE)

(73) Assignee: Henkel Kommanditgesellschaft auf Aktien (Henkel KGaA), Duesseldorf (DE)

( * ) Notice: Subject to any disclaimer, the term of this patent is extended or adjusted under 35 U.S.C. 154(b) by 0 days.

(21) Appl. No.: 10/285,048

(22) Filed: Oct. 31, 2002

(65) Prior Publication Data

US 2003/0087770 A1 May 8, 2003

(30) Foreign Application Priority Data

Nov. 2, 2001 (DE) ..... 101 54 105

(51) Int. Cl.[7] ..... C10M 173/00; B01F 3/08

(52) U.S. Cl. ..... 508/431; 508/279; 508/433; 508/440; 508/459; 508/530; 508/539; 508/579; 508/583; 252/389.2; 252/396; 516/56; 516/57; 516/75; 516/76

(58) Field of Search ..... 508/579, 431, 508/433, 441

(56) References Cited

U.S. PATENT DOCUMENTS

| | | | | | |
|---|---|---|---|---|---|
| 3,945,930 | A | * | 3/1976 | Sugiyama et al. | 508/431 |
| 4,578,208 | A | | 3/1986 | Geke et al. | |
| 4,654,155 | A | * | 3/1987 | Kipp et al. | 508/250 |
| 5,080,814 | A | * | 1/1992 | Awad | 508/501 |
| 5,744,432 | A | * | 4/1998 | Barnhorst et al. | 508/431 |
| 6,204,227 | B1 | * | 3/2001 | Rao et al. | 508/433 |
| 6,316,394 | B1 | * | 11/2001 | Morgan et al. | 508/429 |
| 6,420,323 | B2 | * | 7/2002 | Geke et al. | 508/532 |
| 6,524,396 | B1 | * | 2/2003 | Geke et al. | 134/28 |
| 6,592,775 | B1 | * | 7/2003 | Skold | 252/73 |
| 6,617,288 | B1 | * | 9/2003 | Mathur et al. | 508/431 |
| 2001/0056046 | A1 | | 12/2001 | Geke et al. | |

FOREIGN PATENT DOCUMENTS

| | | |
|---|---|---|
| DE | 197 03 083 A1 | 7/1998 |
| DE | 199 56 237 A1 | 5/2001 |
| EP | 0 124 851 B1 | 10/1988 |

OTHER PUBLICATIONS

"Determination of corrosion preventing characteristics of cooling lubricants mixed with water—Herbert corrosion test", Beuth Verlag, GmbH, Berlin (DIN 51 360 Part 1), Aug. 1985.

Determination of corrosion preventing characteristics of cooling lubricants mixed with water—Chip/filter paper method, Beuth Verlag GmbH, Berlin (DIN 51 360 Part 2), Jul. 1981.

Prufung der Bestandigkeit in harlem Wasser emulglerter Kuhlschmierstoffe, Alleivenkauk der Normem durch Beuth Verlag GmbH (DIN 51 367), Aug. 1991.

* cited by examiner

*Primary Examiner*—Ellen M McAvoy
(74) *Attorney, Agent, or Firm*—Woodcock Washburn LLP

(57) ABSTRACT

Emulsifier system containing a) ethoxylates/propoxylates of fatty alcohols with 8 to 18 C atoms in the alcohol with 2 to 6 ethylene oxide units and 4 to 8 propylene oxide units, b) fatty alcohols and/or fatty alcohol propoxylates with 12 to 24 C atoms in the alcohol and 0 to 3 propylene oxide units and/or distillation residue of these fatty alcohols and c) phosphates, selected from: c1) mono- and/or diesters of phosphoric acid with alkanols with 10–20 C atoms, c2) mono- and/or diesters of phosphoric acid with ethoxylated and/or propoxylated alkanols with 10–20 C atoms and/or c3) phosphates of polyethylene glycol ethers and/or polypropylene glycol ethers, and the water-soluble salts of each of these, in a weight ratio a:b:c=1:0.3:0.1 to 1:4:1; anti-corrosive and emulsifier system with these components, emulsion concentrate with these components, oil-in-water emulsion obtainable therefrom and use thereof as a cleaning, anti-corrosive and low-temperature lubricant emulsion.

24 Claims, No Drawings

EMULSIFIER SYSTEM, ANTI-CORROSIVE AND LOW-TEMPERATURE LUBRICANT EMULSION

BACKGROUND OF THE INVENTION

FIELD OF THE INVENTION

The invention relates to an emulsifier system, which is suitable for the production of low-foaming oil-in-water emulsions in soft and in hard water. The emulsifier system can be supplemented with suitable carboxylic acids to form an anti-corrosive system. The invention further relates to an oil-containing, water-miscible emulsion concentrate containing the emulsifier system according to the invention, and ready-to-use oil-in-water emulsions made therefrom. These emulsions display only a low tendency to foam, even in soft water and can be used for various technical metalworking processes, e.g. as cleaning, anti-corrosive or low-temperature lubricant emulsions. The emulsions can also be used with hard water. They are stable even at quite high levels of water hardness and have the additional advantage that they hold water hardness (calcium carbonate) in dispersion.

Anti-corrosive emulsions are used as passivating agents for the temporary protection of metallic workpieces against atmospheric influences causing corrosion. They contain substantially non-polar or polar oils, emulsifiers, corrosion inhibitors and water. Commercial systems are based on oil concentrates containing emulsifiers and corrosion inhibitors, but little or no water. The emulsifiers and corrosion inhibitors used must therefore be oil-soluble. For the production of oil-in-water emulsions ("O/W emulsions"), which are used in water-diluted form, these systems must be self-emulsifying.

Low-temperature lubricant emulsions, which are used in shaping metallic workpieces with or without cutting, have a similar composition to anti-corrosive emulsions, since they also have to display a corrosion-inhibiting action. By adding suitable lubricant additives, the lubricant action can be improved.

All these types of emulsion have in common the fact that they tend to foam owing to the emulsifiers used. The tendency to foam is particularly marked if the emulsifier system contains anionic surfactants. When used in hard water, the tendency to foam is reduced by the fact that the anionic surfactants can form sparingly soluble salts with calcium ions, which have a foam-inhibiting effect. In soft to moderately hard water, i.e. in water with less than 120°and especially with less than 80° dH, these emulsions cannot be used because of the high tendency to foam, at least when working by a spray method.

DESCRIPTION OF RELATED ART

DE-A-197 03 083 discloses a low-foam emulsifier system consisting of a) ethoxylates/propoxylates of fatty alcohols with 8 to 18 C atoms in the alcohol with 2 to 6 ethylene oxide units and 4 to 8 propylene oxide units and b) fatty alcohols and/or fatty alcohol propoxylates with 12 to 24 C atoms in the alcohol and 0 to 3 propylene oxide units and/or distillation residue of these fatty alcohols in a weight ratio of a:b=1:0.3 to 0.3:1. This emulsifier system is suitable for the production of emulsions with soft water, since it imparts only a very low foaming tendency to these emulsions. For the production of emulsions with moderately hard or hard water, i.e. with water having a hardness of more than 8° dH, especially with more than 12° dH, however, this emulsifier system is less suitable, since the emulsions with this type of water added do not exhibit satisfactory stability.

This is improved according to the teaching of DE-A-19956237. This document describes an emulsifier system consisting of a) ethoxylates/propoxylates of fatty alcohols with 8 to 18 C atoms in the alcohol with 2 to 6 ethylene oxide units and 4 to 8 propylene oxide units, b) fatty alcohols and/or fatty alcohol propoxylates with 12 to 24 C atoms in the alcohol and 0 to 3 propylene oxide units and/or distillation residue of these fatty alcohols and c) ether carboxylic acids of the general formula (I) or the anions thereof $$R—O—(CHA—CH_2O)_n—(CH_2)_m—COOH \quad (I),$$

wherein R denotes a saturated or unsaturated, linear or branched alkyl residue with 5 to 22 C atoms, A denotes hydrogen or a methyl group, n denotes a number in the range of 1.5 to 15 and m denotes an integer in the range of 1 to 3, in the weight ratio a:b:c=1:0.3:0.1 to 1:4:1.

The above document also discloses an anti-corrosive and emulsifier system consisting of 8 to 40 parts by weight of one or more straight-chained or branched carboxylic acids with 6 to 12 C atoms or the anions thereof, and 7 to 50 parts by weight of emulsifier component composed of a) ethoxylates/propoxylates of fatty alcohols with 8 to 18 C atoms in the alcohol with 2 to 6 ethylene oxide units and 4 to 8 propylene oxide units, b) fatty alcohols and/or fatty alcohol propoxylates with 12 to 24 C atoms in the alcohol and 0 to 3 propylene oxide units and/or distillation residue of these fatty alcohols and c) ether carboxylic acids of the general formula (I) or the anions thereof.

The said document also provides oil-containing emulsion concentrates and anti-corrosive and low-temperature lubricant emulsions obtainable therefrom.

Emulsions according to the document cited above, which contain ether carboxylic acids, display good initial foam properties when used in practice. However, it has been shown in practice that the foam behaviour deteriorates with an increasing period of use. In low-temperature lubricant equipment filled with corresponding emulsions, only negligible foaming occurs at first. After a period of use of several days, however, undesirable foaming of varying intensity can occur. The present invention is based on the object of providing an improved emulsifier system, emulsion concentrates containing this and anti-corrosive and low-temperature lubricant emulsions obtainable therefrom.

BRIEF SUMMARY OF THE INVENTION

In a first aspect the invention relates to an emulsifier system containing a) ethoxylates/propoxylates of fatty alcohols with 8 to 18 C atoms in the alcohol with 2 to 6 ethylene oxide units and 4 to 8 propylene oxide units, b) fatty alcohols and/or fatty alcohol propoxylates with 12 to 24 C atoms in the alcohol and 0 to 3 propylene oxide units and c) phosphates, selected from c1) mono- and/or diesters of phosphoric acid with alkanols with 10–20 C atoms, c2) mono- and/or diesters of phosphoric acid with ethoxylated and/or propoxylated alkanols with 10–20 C atoms and/or c3) phosphates of polyethylene glycol ethers and/or polypropylene glycol ethers and the water-soluble salts of each of these, in a weight ratio a:b:c=1:0.3:0.1 to 1:4:1, preferably in a weight ratio of 1:1:0.1 to 1:3:0.5. All the alcohols mentioned can be straight-chained, branched, saturated or unsaturated. Straight-chained alcohols are particularly preferred. The monoesters of phosphoric acid with ethoxylated, straight-chained alcohols with 10–20 C atoms are preferably used as the phosphates of group c). In addition to the acid esters of group c), their water-soluble salts can be used, i.e. salts that are water-soluble in the concentration ranges described below at conventional working temperatures of between 15 and 95° C. The sodium, potassium, ammonium or alkanolamine salts are particularly suitable for this.

DETAILED DESCRIPTION OF THE INVENTION

The use of phosphates c) in cleaning and anti-corrosive agents is known from EP-B-124 851. The esters listed there can also be used within the framework of the present invention. As phosphates with ethoxylated and/or propoxylated alkanols with 10–20 C atoms (group c2), those having 2 to 20, preferably 4 to 14, ethylene oxide and/or propylene oxide units are particularly suitable. Phosphates of group c3) can be obtained e.g. by reacting 10 parts of dipropylene glycol with 282 parts of propylene oxide and 30.5 parts of polyphosphoric acid. By varying the quantitative ratios, correspondingly modified esters are obtained.

Narrow requirements have therefore to be laid down for the composition of the emulsifier system and the molecular structure of the emulsifiers used. On the one hand, according to a) fatty alcohol ethoxylates/propoxylates having both 2 to 6 ethylene oxide units and 4 to 8 propylene oxide units must be present. These more hydrophilic components are to be combined with the more hydrophobic components b) non-alkoxylated fatty alcohols with 12 to 24 C atoms or their alkoxylation products with up to an average of no more than 3 propylene oxide units. Furthermore, the approximate weight ratio stated has to be observed.

This emulsifier system can, as described below, be supplemented with other components to form cleaning, anti-corrosive and/or low-temperature lubricant emulsions. The emulsifier system can, however, also be marketed as such. The purchaser can then use it to formulate the desired type of emulsion. In a first step the emulsifier system can be supplemented with an anti-corrosive component, from which a concentrate for an anti-corrosive emulsion can be produced by adding oil. In a second aspect, therefore, the invention relates to an anti-corrosive and emulsifier system containing 8 to 40 parts by weight of one or more straight-chained or branched carboxylic acids with 6 to 12 C atoms or the anions thereof, and 7 to 50 parts by weight of emulsifier component composed of a) ethoxylates/propoxylates of fatty alcohols with 8 to 18 C atoms in the alcohol with 2 to 6 ethylene oxide units and 4 to 8 propylene oxide units, b) fatty alcohols and/or fatty alcohol propoxylates with 12 to 24 C atoms in the alcohol and 0 to 3 propylene oxide units and c) phosphates, selected from c1) mono- and/or diesters of phosphoric acid with alkanols with 10–20 C atoms, c2) mono- and/or diesters of phosphoric acid with ethoxylated and/or propoxylated alkanols with 10–20 C atoms and/or c3) phosphates of polyethylene glycol ethers and/or polypropylene glycol ethers and the water-soluble salts of each of these. in a weight ratio a:b:c=1:0.3:0.1 to 1:4:1, preferably 1:1:0.1 to 1:3:0.5.

For the alcohols, phosphates of group c) and the water-soluble salts thereof preferably to be used, the above statements apply.

Since anti-corrosive emulsions conventionally have neutral to basic pH values, it is preferable to use the carboxylic acids at least partially in neutralized form, i.e. as salts. Potassium hydroxide solution and/or alkanolamines are particularly suitable as the basic component for the neutralization, with the latter reinforcing the corrosion inhibitor action. Owing to the risk of nitrosamine formation, the use of dialkanolamines is less preferred. Instead, monoalkanolamines or trialkanolamines, or preferably mixtures thereof, are used. Ethanolamines are particularly used.

The carboxylic acids having a corrosion-inhibiting action can be straight-chained or branched. Mixtures of different acids can be particularly advantageous. Preferred examples of these carboxylic acids are caprylic acid, ethylhexanoic acid, isononanoic acid and isodecanoic acid.

If the anti-corrosive and emulsifier system is also to be suitable for the production of emulsions with which light metals, e.g. aluminum, magnesium or the alloys thereof, are to be treated, preferably alkylphosphonic acids with 4 to 18 C atoms, preferably with 6 to 12 C atoms, or the salts thereof are added to the anti-corrosive and emulsifier system. The anti-corrosive and emulsifier system preferably contains these phosphonic acids or their anions in a quantity of 0.1 to 4, preferably 0.2 to 2 parts by weight. A special example of a suitable phosphonic acid is n-alkylphosphonic acid.

If the anti-corrosive and emulsifier system is additionally to be suitable for emulsions that are suitable for the treatment of non-ferrous heavy metals, such as e.g. copper, bronze or brass, it preferably contains non-ferrous heavy metal inhibitors. These can be selected from the group of the triazoles, particularly from benzotriazoles and tolyltriazoles. The anti-corrosive and emulsifier system preferably contains approximately 0.1 to 1 part by weight of non-ferrous heavy metal inhibitors in this case.

In another aspect, the invention relates to an oil-containing, water-miscible emulsion concentrate containing 15 to 50 parts by weight of an oil component, 30 to 80 parts by weight of the anti-corrosive and emulsifier system according to one or more of claims 2 to 5 and, if desired, other auxiliary or active substances.

A concentrate of this type can be obtained by adding the appropriate parts by weight of an oil component to the anti-corrosive and emulsifier system described above. It is, of course, possible to produce a concentrate of this type by mixing together in any order the oil component, the individual emulsifiers of the emulsifier system and the carboxylic acids. The carboxylic acids can be used directly in the form of salts. However, it is technically more advantageous to mix the acids into the other components as they are and only to neutralize them by adding alkali metal hydroxide solution, especially potassium hydroxide solution, and/or alkanolamines after mixing with the oil component and the emulsifier system.

Non-polar or polar oils of petrochemical or natural origin (=based on vegetable or animal oils or fats) can be used as the oil component. Synthetic oil components are also suitable. Examples of oil components that can be used are paraffinic or naphthenic mineral oil, dialkyl ethers with 12 to 20 C atoms and/or ester oils.

The following can be mentioned as optional other auxiliary or active substances: lubricant additives in general, and particularly so-called "extreme-pressure" additives (so-called EP additives), other corrosion inhibitors, such as e.g. boric acid (which, however, is preferably omitted as stated below) or additional alkanolamines, solubilisers such as e.g. glycols, glycerin or Na-cumenesulfonate. Biocides, which prolong the shelf life of the emulsion, can also be added.

The invention further relates to the ready-to-use oil-in-water emulsion, which is obtainable by adding approximately 99.5 to approximately 90 parts by weight of water to approximately 0.5 to approximately 10 parts by weight of the concentrate described above. Because of the self-emulsifying properties of the emulsion concentrate, the ready-to-use emulsion forms spontaneously when water is added, or after slight mechanical movement, such as e.g. stirring. This emulsion can be used e.g. as a cleaning, anti-corrosive or low-temperature lubricant emulsion. When soft water is used to prepare the emulsion, this then exhibits the great advantage of only a low tendency to foam. It can therefore be used in spraying processes in the temperature range between the freezing point and the boiling point of the emulsion and requires no minimum temperature for spray applications. When used as a low-temperature lubricant emulsion, the low foam level also makes a positive impact.

The emulsions can be prepared with water of any hardness that occurs, i.e. both with soft water with a hardness of less than 8° dH or even less than 4° dH, but also in moderately hard or hard water, i.e. in water with a hardness of more than 8° dH, more than 12° dH and even in the range of 30 to 40° dH. Owing to the novel emulsifier system, the emulsions are stable even at the above higher levels of water hardness. They have the additional advantage that water hardness (calcium carbonate) remains dispersed and is not precipitated on to workpieces, tools or equipment parts. Consequently, owing to the present invention it is possible to produce usable emulsions with water of greatly differing degrees of hardness using a single concentrate. The emulsions are sufficiently low-foam to be able to be sprayed at any temperature. They also display the required long-term stability.

In a particular embodiment, the invention relates to the use of an oil-in-water emulsion, which is obtainable by mixing 0.5 to 10 parts by weight of an oil-containing, water-miscible emulsion concentrate containing 15 to 50 parts by weight of an oil component, 30 to 80 parts by weight of the anti-corrosive and emulsifier system according to claim 4 and, if desired, other auxiliary or active substances, with 99.5 to 90 parts by weight of water, as a low-temperature lubricant in the machining of light metals.

Light metals here means in particular aluminum and magnesium and the alloys of each of these consisting of more than 50 atomic % aluminum or magnesium. The above statements apply to the components of this emulsion preferably to be used.

In another special aspect the invention relates to the use of an oil-in-water emulsion, which is obtainable by mixing 0.5 to 10 parts by weight of an oil-containing, water-miscible emulsion concentrate containing 15 to 50 parts by weight of an oil component, 30 to 80 parts by weight of the anti-corrosive and emulsifier system according to claim 5 and, if desired, other auxiliary or active substances, with 99.5 to 90 parts by weight of water, as a low-temperature lubricant in the machining of non-ferrous heavy metals.

Non-ferrous heavy metals here means in particular copper and its alloys, e.g. brass or bronze. Here too, the above statements apply to the preferred components of this emulsion.

In particular in the context of the present invention, emulsion concentrates and emulsions are preferred which contain both the above alkylphosphonic acids as light metal inhibitors and the above non-ferrous heavy metal inhibitors. These types of emulsions have the advantage that they are suitable for the machining of components made of virtually all metals and metal alloys occurring in equipment and vehicle construction. The emulsion does not therefore have to be changed when machining different types of metal.

It is particularly provided in the context of the present invention that the emulsion according to the invention does not contain any boron compounds. Consequently, no application problems occur as a result of hard residues on the parts and no environmental problems occur from boron-containing waste water.

EXAMPLES

Some examples of emulsion concentrates according to the invention containing the emulsifier system according to the invention are listed below. They were obtained by stirring together the components in the order stated. Table 1 shows the emulsion concentrates produced as examples. EO stands for ethylene oxide, PO for propylene oxide, FA for fatty alcohol. Figures quoted are parts by weight.

TABLE 1

| | Example no. | | |
|---|---|---|---|
| | Comp. | Ex. 1 | Ex. 2 |
| Mineral oil, paraffinic | 17.0 | 17.0 | 15.0 |
| Rape oil (fatty acid triglyceride) | 7.0 | 7.0 | 7.0 |
| Isononanoic acid | 9.6 | 9.6 | 9.6 |
| Caprylic acid | 9.6 | 9.6 | 9.6 |
| Triethanolamine | 5.0 | 5.0 | 5.0 |
| $C_{12-14}$ FA x 3 EO x 6 PO | 8.5 | 8.5 | 8.5 |
| Oleyl cetyl alcohol x 2 PO | 8.5 | 8.5 | 8.5 |
| Oleyl alcohol | 14.0 | 14.0 | 14.0 |
| KOH 50% | 15.0 | 15.0 | 15.0 |
| n-Octanephosphonic acid | 0.5 | 0.5 | 0.5 |
| 1H-1,2,3-Benzotriazole | 0.2 | 0.2 | 0.2 |
| Phosphoric acid monoester with $C_{12-18}$ FA x 9.5 EO - monoethanolamine salt | — | — | 4.0 |
| Phosphoric acid monoester with $C_{12-18}$ FA x 9.5 EO - monoethanolamine salt | — | 1.0 | — |
| Water + biocide (3.0%) | 5.1 | 4.1 | 3.1 |

Each of these mixtures gave a clear and homogeneous concentrate, from each of which a 5% emulsion in deionized water (0° dH) and in DIN water (20° dH) was prepared.

Water according to DIN 51360 was prepared as follows: a solution A is prepared, by dissolving 39 g of calcium chloride hexahydrate with deionized water to a volume of one liter. A solution B is also prepared by dissolving 44 g of magnesium sulfate heptahydrate with deionized water to a volume of one liter. 17 ml of the solution A and 3 ml of the solution B are taken and 980 ml of deionized water are added.

5% emulsions in both grades of water, to each of which 0.5% sodium chloride had previously been added to increase the electrolyte content, were also prepared.

Water Characteristics:

| | Deionized water (0° dH) | Deionized water + 0.5% NaCl | DIN water (20° dH) | DIN water + 0.5% NaCl |
|---|---|---|---|---|
| pH value | 9.10 | 6.55 | 8.00 | 7.37 |
| Electr. conductivity (mS/cm) | 0.0075 | 7.88 | 0.798 | 8.80 |

The emulsion stability of the above-mentioned emulsions—12 in total—was investigated in accordance with DIN 51367: "Testing of the stability of emulsified low-temperature lubricants in hard water".

result after 24 hours and after 5 days:

(The stability according to DIN 51367 is given in %, rounded to a whole %):

| 5% emulsion of no. | Comp. | Ex. 1 | Ex. 2 |
|---|---|---|---|
| in deionized water (0° dH): | 95% | 100% | 100% |
| in DIN water (20° dH): | 80% | 90% | 100% |
| in deionized water + 0.5% NaCl: | 90% | 95% | 100% |
| in DIN water + 0.5% NaCl: | 20% | 80% | 100% |

These experimental data clearly show the positive influence of the phosphates on the emulsion stability in harder waters and with an increased electrolyte load.

To compare the foam properties of an emulsion according to the invention with an otherwise similarly composed emulsion, but in which an ether carboxylic acid was used according to DE-A-19956237 instead of the phosphate, the following test was performed. The foam behavior of emulsions according to the invention made from the concentrate according to example 2 was compared with emulsions of the same composition as example 2 except that, instead of the phosphate, a $C_{12-14}$ fatty alcohol×2.5 EO ether carboxylic acid was used.

Test method: 100 ml of freshly prepared 5% emulsions in water of 20° dH, 10° dH and in deionized water are shaken vigorously in a closed 250 ml shaking cylinder 20 times and then the time taken for the foam to break down completely is measured.

Foam breakdown period of freshly prepared emulsion: 7 seconds

Foam breakdown period after standing for 24 hours: 3 minutes

Foam breakdown period after standing for 48 hours: >7 minutes, 10 ml stable residual foam Similar results were also achieved with other foam test methods, e.g. Ultraturrax (2 minutes at 10,000 rpm) or in the 4 l pump circulation test.

After exchanging the ether carboxylic acids with the phosphate, this problematic foaming no longer occurred: several-day-old emulsions display foam breakdown equally as rapid as freshly prepared ones. This was confirmed in practical tests over several months.

What is claimed is:

1. An emulsifier system comprising the following components a) ethoxylates/propoxylates of fatty alcohols having 8 to 18 C atoms in the alcohol with 2 to 6 ethylene oxide units and 4 to 8 propylene oxide units;

b) fatty alcohols or fatty alcohol propoxylates having 12 to 24 C atoms in the alcohol and 0 to 3 propylene oxide units, or mixtures thereof; and c) phosphates selected from one or more of c1) mono-esters, di-esters or mixtures thereof of phosphoric acid with alkanols having 10–20 C atoms, c2) mono-esters, di-esters or mixtures thereof of phosphoric acid with ethoxylated or propoxylated or ethoxylated and propoxylated alkanols having 10–20 C atoms; and c3) phosphates of polyethylene glycol ethers, polypropylene glycol ethers or mixtures thereof, and the water-soluble salts of each of these, wherein the weight ratio a:b:c is from1:0.3:0.1 to 1:4:1.

2. An emulsifier system according to claim 1 wherein the fatty alcohols of components a) or b) or both are straight-chained.

3. An emulsifier system according to claim 1 wherein the alkanols of components c1) or c2) or both are straight-chained.

4. An emulsifier system according to claim 1 wherein the mono-esters or di-esters of component c2) have from 4 to 14 ethylene/propylene oxide units.

5. An anti-corrosive and emulsifier system comprising (I) 8 to 40 parts by weight of one or more straight-chained or branched carboxylic acids having 6 to 12 C atoms or the anions thereof, and (II) 7 to 50 parts by weight of emulsifier component comprised of a) ethoxylates/propoxylates of fatty alcohols having 8 to 18 C atoms in the alcohol with 2 to 6 ethylene oxide units and 4 to 8 propylene oxide units;

b) fatty alcohols or fatty alcohol propoxylates having 12 to 24 C atoms in the alcohol and 0 to 3 propylene oxide units, or mixtures thereof; and c) phosphates selected from one or more of c1) mono-esters, di-esters or mixtures thereof of phosphoric acid with alkanols having 10–20 C atoms, c2) mono-esters, di-esters or mixtures thereof of phosphoric acid with ethoxylated or propoxylated or ethoxylated and propoxylated alkanols having 10–20 C atoms; and c3) phosphates of polyethylene glycol ethers, polypropylene glycol ethers or mixtures thereof, and the water-soluble salts of each of these, wherein the weight ratio a:b:c is from 1:03:0.1 to 1:4:1.

6. An anti-corrosive and emulsifier system according to claim 5 wherein the carboxylic acids of component (I) are partially or completely present as potassium salts or alkanolammonium salts or a mixture thereof.

7. An anti-corrosive and emulsifier system according to claim 5 wherein the fatty alcohols of components a) or b) or both are straight-chained.

8. An anti-corrosive and emulsifier system according to claim 5 wherein the alkanols of components c1) or c2) or both are straight-chained.

9. An anti-corrosive and emulsifier system according to claim 5 wherein the mono-esters or di-esters of component c2) have from 4 to 14 ethylene/propylene oxide units.

10. An anti-corrosive and emulsifier system according to claim 5 further comprising one or more light metal inhibitors.

11. An anti-corrosive and emulsifier system according to 10 wherein said one or more light metal inhibitors comprise alkylphosphonic acids having 4 to 18 C atoms, or the anions thereof, in a quantity of 0.1 to 4 parts by weight.

12. An anti-corrosive and emulsifier system according to claim 5 further comprising one or more non-ferrous heavy metal inhibitors.

13. An anti-corrosive and emulsifier system to claim 12 wherein said one or more non-ferrous heavy metal inhibitors are selected from one or more triazoles, in a quantity of 0.1 to 1 part by weight.

14. An oil-containing, water-miscible emulsion concentrate comprising (A) 15 to 50 parts by weight of an oil component, (B) 30 to 80 parts by weight of an anti-corrosive and emulsifier system comprising (I) 8 to 40 parts by weight of one or more straight-chained or branched carboxylic acids having 6 to 12 C atoms or the anions thereof, and (II) 7 to 50 parts by weight of emulsifier component comprised of a) ethoxylates/propoxylates of fatty alcohols having 8 to 18 C atoms in the alcohol with 2 to 6 ethylene oxide units and 4 to 8 propylene oxide units;

b) fatty alcohols or fatty alcohol propoxylates having 12 to 24 C atoms in the alcohol and 0 to 3 propylene oxide units, or mixtures thereof; and c) phosphates selected from one or more of c1) mono-esters, di-esters or mixtures thereof of phosphoric acid with alkanols having 10–20 C atoms, c2) mono-esters, di-esters or mixtures thereof of phosphoric acid with ethoxylated or propoxylated or ethoxylated and propoxylated alkanols having 10–20 C atoms; and c3) phosphates of polyethylene glycol ethers, polypropylene glycol ethers or mixtures thereof, and the water-soluble salts of each of these, wherein the weight ratio a:b:c is from 1:0.3:0.1 to 1:4:1.

15. An oil-containing, water miscible concentrate according to claim 14 wherein the fatty alcohols of components IIa) or IIb) or both are straight-chained.

16. An oil-containing, water miscible concentrate according to claim 14 wherein the alkanols of components IIc1) or IIc2) or both are straight-chained.

17. An oil-containing, water miscible concentrate according to claim 14 wherein the mono-esters or di-esters of component IIc2) have from 4 to 14 ethylene/propylene oxide units.

18. An oil-containing, water-miscible emulsion concentrate according to claim 14, further comprising one or more oils selected from the group consisting of paraffinic or naphthenic mineral oil, dialkyl ethers having 12 to 20 C atoms or ester oils.

19. An oil-containing, water-miscible emulsion concentrate according to claim 14, further comprising one or more additives selected from lubricant additives, EP additives, other corrosion inhibitors and biocides.

20. An oil-in-water emulsion obtainable by mixing together 0.5 to 10 parts by weight of an oil-containing, water-miscible emulsion concentrate according to claim 14 and 99.5 to 90 parts by weight of water.

21. An oil-in-water emulsion according to claim 20 which is essentially free from boron compounds.

22. A method of cleaning or providing corrosion resistance to a metal substrate, said method comprising contacting said metal substrate with an oil-in-water emulsion according to claim 20.

23. A method of lubricating a light metal object during a low temperature machining operation, said method comprising contacting said light metal object with an oil-in-water emulsion according to claim 20 during said machining operation.

24. A method lubricating a non-ferrous heavy metal object during a low temperature machining operation, said method comprising contacting said nonferrous heavy metal object with an oil-in-water emulsion according to claim 20 during said machining operation.

* * * * *

UNITED STATES PATENT AND TRADEMARK OFFICE

CERTIFICATE OF CORRECTION

PATENT NO. : 6,780,824 B2
DATED : August 24, 2004
INVENTOR(S) : Oelscher et al.

It is certified that error appears in the above-identified patent and that said Letters Patent is hereby corrected as shown below:

Column 1,
Line 50, delete "120º" and replace with -- 12º --.
Line 51, delete "80º" and replace with -- 8º --.

Signed and Sealed this

Eighth Day of March, 2005

JON W. DUDAS
*Director of the United States Patent and Trademark Office*